US007214343B2

(12) United States Patent
Kuniyoshi et al.

(10) Patent No.: US 7,214,343 B2
(45) Date of Patent: May 8, 2007

(54) METHOD FOR PRODUCING GRANULATED POWDER OF R—FE—B TYPE ALLOY AND METHOD FOR PRODUCING R—FE—B TYPE ALLOY SINTERED COMPACT

(75) Inventors: Futoshi Kuniyoshi, Osaka (JP); Yuji Kaneko, Osaka (JP); Akihito Tsujimoto, Osaka (JP); Kazunari Shimauchi, Osaka (JP); Kazuo Tanaka, Kanagawa (JP); Shizuo Mori, Kanagawa (JP); Kiyofumi Suzuki, Kanagawa (JP)

(73) Assignee: Neomax Co., Ltd., Osaka (JP)

( * ) Notice: Subject to any disclaimer, the term of this patent is extended or adjusted under 35 U.S.C. 154(b) by 229 days.

(21) Appl. No.: 10/473,335

(22) PCT Filed: Mar. 27, 2002

(86) PCT No.: PCT/JP02/03023

§ 371 (c)(1),
(2), (4) Date: Mar. 29, 2004

(87) PCT Pub. No.: WO02/078882

PCT Pub. Date: Oct. 10, 2002

(65) Prior Publication Data

US 2004/0149354 A1 Aug. 5, 2004

(30) Foreign Application Priority Data

Mar. 29, 2001 (JP) ..... 2001-096572

(51) Int. Cl.
*B22F 9/04* (2006.01)

(52) U.S. Cl. ..... 419/12; 419/33; 75/349

(58) Field of Classification Search ..... 75/349; 419/12, 33, 36

See application file for complete search history.

(56) References Cited

U.S. PATENT DOCUMENTS

| | | | | |
|---|---|---|---|---|
| 4,770,723 | A | 9/1988 | Sagawa et al. | |
| 4,792,368 | A | 12/1988 | Sagawa et al. | |
| 5,167,914 | A * | 12/1992 | Fujimura et al. | 419/11 |
| 5,192,372 | A | 3/1993 | Fujimura et al. | |
| 5,383,978 | A | 1/1995 | Yamamoto et al. | |
| 5,666,635 | A | 9/1997 | Kaneko et al. | |
| 6,187,259 | B1 * | 2/2001 | Yamashita et al. | 419/12 |
| 6,885,267 | B2 * | 4/2005 | Kuriyama et al. | 335/306 |

FOREIGN PATENT DOCUMENTS

| | | |
|---|---|---|
| CS | 277505 B6 | 3/1993 |
| EP | 0 778 594 A1 | 6/1997 |
| EP | 0 991 086 A1 | 4/2000 |
| EP | 1 020 285 A2 | 7/2000 |
| JP | 56-122105 | 9/1981 |
| JP | 57-124599 | 8/1982 |
| JP | 63-110521 | 7/1988 |
| JP | 63-237402 | 10/1988 |
| JP | 08-107034 | 4/1996 |
| JP | 09-17674 | 1/1997 |
| JP | 10-58198 | 3/1998 |

* cited by examiner

OTHER PUBLICATIONS

Neomax Co., Ltd., *European Search Report*, 02708697.4-122-JP0203023, Feb. 22, 2005.

*Primary Examiner*—George Wyszomierski
(74) *Attorney, Agent, or Firm*—Nixon Peabody LLP; Jeffrey L. Costellia

(57) ABSTRACT

The method for producing a granulated powder of the present invention includes the steps of: preparing an R—Fe—B alloy powder; and granulating the alloy powder using at least one kind of granulating agent selected from normal paraffins, isoparaffins and depolymerized oligomers, to prepare a granulated powder. The produced R—Fe—B alloy granulated powder is excellent in flowability and compactibility as well as in binder removability.

6 Claims, 2 Drawing Sheets

METHOD FOR PRODUCING GRANULATED POWDER OF R—FE—B TYPE ALLOY AND METHOD FOR PRODUCING R—FE—B TYPE ALLOY SINTERED COMPACT

TECHNICAL FIELD

The present invention relates to a method for producing a granulated powder of an R—Fe—B alloy and a method for producing an R—Fe—B alloy sintered body using the granulated powder.

BACKGROUND ART

A sintered magnet (permanent magnet) of a rare earth alloy is generally produced by compacting powder of the rare earth alloy, sintering the resultant powder compact and subjecting the sintered body to aging. At present, two types of magnets, samarium-cobalt magnets and neodymium-iron-boron magnets, are extensively used in various fields. Among others, neodymium-iron-boron magnets (hereinafter, referred to as "R—Fe—B magnets" where R is any of the rare earth elements including Y, Fe is iron and B is boron) are higher in maximum energy product than any of other various types of magnets, and yet relatively inexpensive. Therefore, the R—Fe—B magnets find positive applications to various types of electronic appliances.

The R—Fe—B sintered magnet is essentially composed of a major phase of an $R_2Fe_{14}B$ compound of tetragonal system, an R-rich phase made of Nd and the like, and a B-rich phase. A transition metal such as Co and Ni may substitute for part of Fe, and carbon (C) may substitute for part of boron (B). R—Fe—B sintered magnets to which the present invention is suitably applied are described in U.S. Pat. Nos. 4,770,723 and No. 4,792,368, for example.

To prepare an R—Fe—B alloy from which the magnet described above is produced, an ingot casting process has been conventionally employed. In a normal ingot casting process, rare earth metal, electrolytic iron and a ferroboron alloy as starting materials are subjected to high-frequency melting, and the resultant melt is cooled relatively slowly in a casting mold, to thereby obtain an alloy ingot.

Recently, a rapid cooling process such as a strip casting process and a centrifugal casting process has attracted much attention in the art. In the rapid cooling process, a molten alloy is brought into contact with a single roll, a twin roll, a rotating disk, the inner wall of a rotating cylindrical casting mold or the like, to permit comparatively rapid cooling of the molten alloy and in this way, prepare a solidified alloy thinner than an alloy ingot from the molten alloy (hereinafter, such a solidified alloy is called "alloy flakes"). The alloy flakes prepared by such a rapid cooling process normally have a thickness in the range of about 0.03 mm to about 10 mm. According to the rapid cooling process, the molten alloy starts to be solidified from a surface thereof brought into contact with the chill roll (roll contact surface), and crystals grow in a columnar shape in the thickness direction from the roll contact surface. The resultant rapidly solidified alloy, prepared by the strip casting process or the like, has a structure essentially composed of an $R_2Fe_{14}B$ crystalline phase, having a minor-axis size of about 0.1 μm to about 100 μm and a major-axis size of about 5 μm to about 500 μm, and an R-rich phase dispersed in the grain boundary between the $R_2Fe_{14}B$ crystalline phases. The R-rich phase is a non-magnetic phase including a rare earth element R in a relatively high concentration, and has a thickness (corresponding to the width of the grain boundary) of about 10 μm or less.

Compared to an alloy prepared by the conventional ingot casting process (die casting process) (hereinafter, such an alloy is called an "ingot alloy"), the rapidly solidified alloy has been cooled in a relatively shorter time (cooling rate: $10^{2\circ}$ C./sec to $10^{4\circ}$ C./sec). Accordingly, the rapidly solidified alloy has features that the structure is fine and the crystal grain size is small. In addition, the area of the grain boundary is large and the R-rich phase is dispersed broadly in the grain boundary. Therefore, the rapidly solidified alloy has another feature of excelling in the dispersiveness of the R-rich phase. By using the rapidly solidified alloy having these features, a magnet with excellent magnetic properties can be produced.

An alloy preparation method called a Ca reduction process (or reduction-diffusion process) is also known. This process includes the following steps. First, metal calcium (Ca) and calcium chloride (CaCl) are added to either a mixed powder including at least one kind of rare earth oxide, iron powder, pure boron powder and at least one kind of ferroboron powder and boron oxide at a predetermined ratio or a mixed powder including alloy powders or mixed oxides of these constituent elements at a predetermined ratio. The resultant mixture is subjected to reduction-diffusion treatment in an inert atmosphere. The resultant reaction product is put into a slurry state, and the slurry is then treated with water, to thereby obtain a solid of an R—Fe—B alloy.

A block of a solid alloy is herein called an "alloy block". The "alloy block" will be any of various forms of solid alloys including not only solidified alloys obtained by cooling melts of an alloy ingot prepared by the conventional ingot casting process, alloy flakes prepared by the rapid cooling process such as the strip casting process and the like, but also a solid alloy prepared by the Ca reduction process.

An alloy powder to be compacted is obtained by coarsely pulverizing an alloy block in any form by a hydrogen pulverization process, for example, and/or any of various mechanical milling processes (for example, using a disk mill), and finely pulverizing the resultant coarse powder (mean particle size: 10 μm to 500 μm, for example) by a dry milling process using a jet mill, for example.

The R—Fe—B alloy powder to be compacted should preferably have a mean particle size of 1.5 μm to 5 μm from the standpoint of the resultant magnetic properties. "The mean particle size" of a powder herein refers to a mass median diameter (MMD) unless otherwise specified. A powder having such a small mean particle size is however poor in flowability and compactibility (including cavity loading capability and compressibility), and thus poor in productivity.

To solve the above problem, coating alloy powder particles with a lubricant has been examined. For example, Japanese Laid-Open Patent Publication No. 08-111308 and its corresponding U.S. Pat. No. 5,666,635 (Assignee: Sumitomo Special Metals Co., Ltd.) disclose the following technique. A lubricant of at least one kind of fatty ester in a liquid form is added in an amount of 0.02 mass % to 5.0 mass % to a rough powder of an R—Fe—B alloy having a mean particle size of 10 μm to 500 μm, and the resultant mixture is pulverized with a jet mill using an inert gas, to prepare a fine powder having a mean particle size of 1.5 μm to 5 μm.

A lubricant improves the flowability and compactibility of powder, and also functions as a binder for imparting rigidity (strength) to a compact. The lubricant however remains in a sintered body as residual carbon causing degradation of magnetic properties, and is therefore required to have good removability. For example, Japanese-Laid Open Patent Publication No. 2000-306753 discloses, as a lubricant having good removability, a depolymerized polymer, a mixture of a depolymerized polymer and a hydrocarbon-based solvent, and a mixture of a depolymerized polymer, a low-viscosity mineral oil and a hydrocarbon-based solvent.

Use of a lubricant described above contributes to some degree of improvement, but fails in imparting sufficient compactibility. In particular, a powder prepared by the strip casting process, which is not only small in mean particle size but also narrow in particle size distribution, is especially poor in flowability. This causes problems such that the amount of powder loaded in a cavity tends to vary beyond an acceptable range, and that the loading density in the cavity tends to lack uniformity. As a result, the mass and size of the resultant compact may vary beyond an acceptable range, and chips and fractures may be formed in the compact.

As another method for improving the flowability and compactibility of a R—Fe—B alloy powder, use of a granulated powder has been attempted.

For example, Japanese Laid-Open Patent Publication No. 63-237402 discloses that compactibility can be improved by use of a granulated powder obtained by adding a mixture of a paraffin mixture that is in the liquid state at room temperature and an aliphatic carboxylic acid in an amount of 0.4 to 4.0 mass % with respect to a powder, and kneading and then granulating the resultant mixture. A method using polyvinyl alcohol (PVA) as a granulating agent is also known. Like the lubricant, the granulating agent functions as a binder imparting strength to a compact.

The granulating agent disclosed in Japanese Laid-Open Patent Publication No. 63-237402 described above is poor in removability. Therefore, in the case of production of an R—Fe—B sintered magnet, the magnetic properties disadvantageously degrade due to carbon remaining in a sintered body.

In the method using PVA, a granulated powder prepared by a spray dryer process using PVA has strong binding force. The resultant granulated powder is too rigid to disintegrate under application of an external magnetic field. Therefore, alloy particles (crystals) fail to be sufficiently aligned in the magnetic field, and as a result, no anisotropic magnet excellent in magnetic properties is obtainable.

PVA is also poor in removability. Therefore, carbon derived from PVA tends to remain in the resultant magnet, causing degradation in magnetic properties. Debindering may be performed in a hydrogen atmosphere. Even with this treatment, however, it is difficult to sufficiently remove the carbon. Also, due to the excessively strong binding force of PVA, the granulated powder fails to disintegrate under application of a magnetic field and therefore finds difficulty in being aligned.

As described above, although various granulating agents have been examined so far, there has not yet been succeeded in development of a granulating agent that has moderate binding force and is excellent in removability. Under this circumstance, a method permitting industrial-scale production of a granulated powder suitably usable for production of an R—Fe—B sintered body has not yet been attained.

Needs for smaller/thinner magnets with higher performance have grown. In this situation, development of a method permitting production of small/thin magnets with high performance with high production efficiency is desired. In general, when an R—Fe—B alloy sintered body (or a magnet obtained by magnetizing the alloy sintered body) is machined, the magnetic properties of the machined product degrade due to machining strain. This degradation of the magnetic properties is not negligible for small magnets. In view of this, as the magnet is smaller, it is desired more strongly that a sintered body in a final use shape should be produced with a level of size accuracy high enough to substantially require no machining. Under this circumstance, also, the demand for an R—Fe—B alloy powder material excellent in flowability and compactibility has been increasingly intensified.

DISCLOSURE OF INVENTION

In view of the above problems, a main object of the present invention is providing a method for producing a granulated powder of an R—Fe—B alloy excellent in flowability and compactibility and also in binder removability, and a method for producing a high-quality R—Fe—B alloy sintered body with high production efficiency.

To attain the object described above, the method for producing a granulated powder of an R—Fe—B alloy of the present invention includes the steps of: preparing an R—Fe—B alloy powder; and granulating the powder using at least one kind of granulating agent selected from a group consisting of normal paraffins, isoparaffins and depolymerized oligomers, to prepare a granulated powder.

The mean particle size of the powder is preferably in a range of 1.5 μm to 5 μm.

The mean molecular weight of the at least one kind of granulating agent is preferably in a range of 120 to 500.

Further preferably, the at least one kind of granulating agent is normal paraffin and/or isoparaffin having a boiling point in a range of 80° C. to 250° C.

In the step of granulating, the at least one kind of granulating agent is preferably added in an amount of 0.1 mass % to 50 mass % with respect to the mass of the granulated powder.

The granulated powder is preferably prepared by a fluidized bed granulation process.

The mean particle size of the granulated powder is preferably in a range of 0.05 mm to 3.0 mm, further preferably in a range of 0.1 mm to 2.0 mm.

To attain the object described above, the method for producing an R—Fe—B alloy sintered body of the present invention includes the steps of: producing a granulated powder by the method for producing a granulated powder of an R—Fe—B alloy described above; compacting an R—Fe—B alloy powder material including the granulated powder in a state of being aligned under application of a magnetic field, to form a compact; and sintering the compact.

The step of sintering is the step of heating the compact in an inert gas atmosphere or in a vacuum, and can also serve as the step of removing the granulating agent.

The powder material substantially includes only the granulated powder.

The R—Fe—B alloy sintered body produced by the method described above may be magnetized, to obtain an R—Fe—B sintered magnet excellent in magnetic properties.

BEST MODE FOR CARRYING OUT THE INVENTION

Hereinafter, the method for producing an R—Fe—B alloy sintered body of an embodiment of the present invention will be described with reference to the accompanying drawings. In the following embodiment, features of the present invention will be described exemplifying a method for producing a sintered magnet using an R—Fe—B alloy powder prepared by the strip casting process. However, the present invention is in no way limited to this specific embodiment, but an R—Fe—B alloy powder prepared by any other process may be used.

Figure 1:
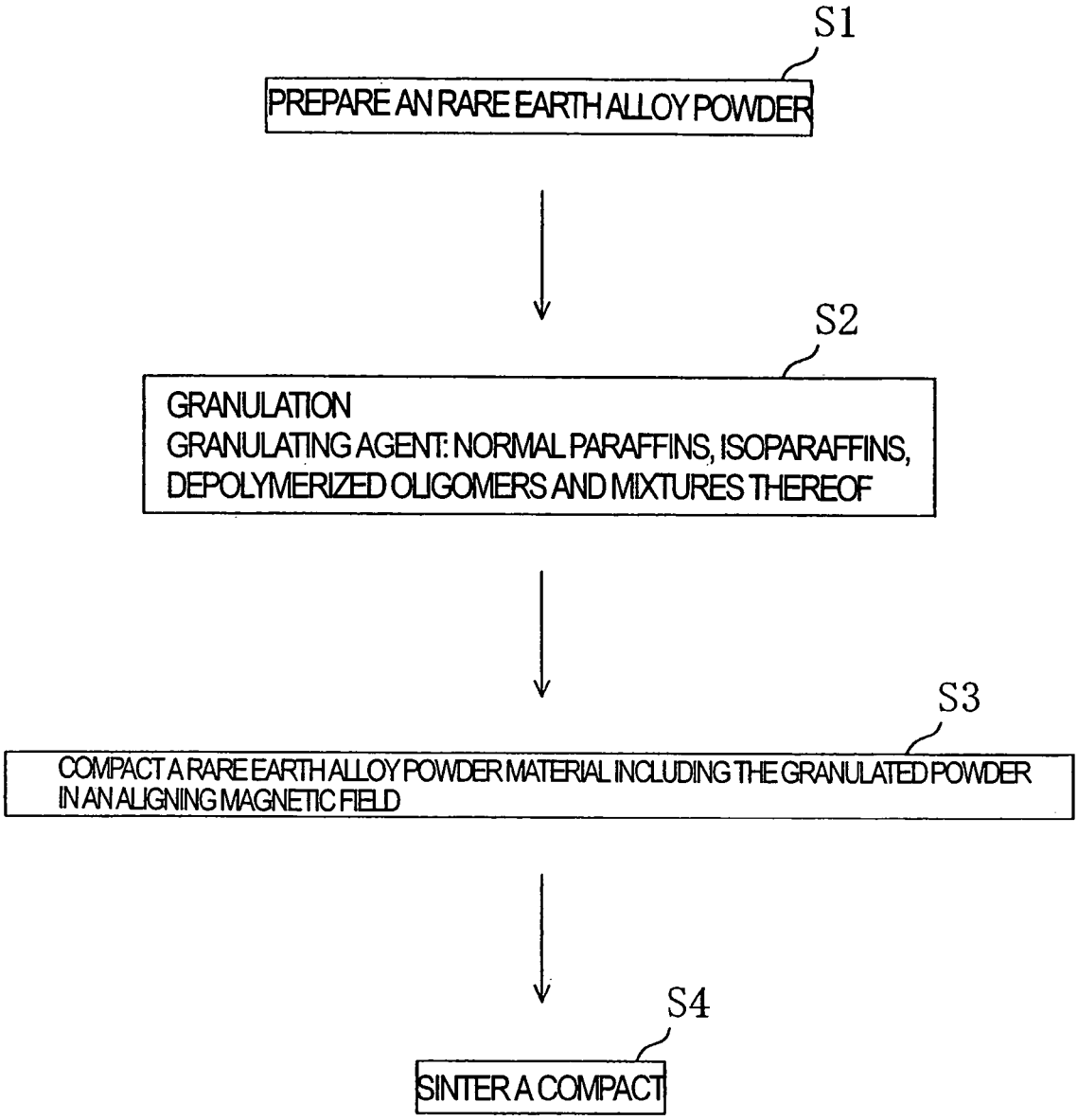
FIG. 1 is a flowchart showing the method for producing an R—Fe—B alloy sintered body of the present invention.

As shown in FIG. 1, the method for producing an R—Fe—B alloy sintered body of the present invention includes: step S1 of preparing a powder of an R—Fe—B alloy; step S2 of granulating the resultant powder with at least one kind of granulating agent selected from a group consisting of normal paraffins, isoparaffins and depolymerized oligomers, to produce a granulated powder; step S3 of compacting an R—Fe—B alloy powder material including the granulated powder in a state of being aligned under application of a magnetic field, to form a compact; and step S4 of sintering the compact. The resultant sintered body may be magnetized in a known way to obtain an R—Fe—B sintered magnet. The magnetization may be performed at an arbitrary time point after the sintering. For example, it may be performed immediately before use of the sintered magnet by the user.

Although only the granulated powder prepared in the manner described above is preferably used as the R—Fe—B alloy powder material to be compacted from the standpoint of the flowability, a mixture of the granulated powder and a primary particle powder (pre-granulation material powder) may also be used. However, the flowability degrades with increase of the percentage of the primary particle powder. To sufficiently secure the effect of improving the flowability by granulation, therefore, substantial use of only the granulated powder is preferred. In the case of mixing the primary particle powder with the granulated powder, the primary particles are preferably coated with a lubricant. By coating the primary particles with a lubricant, the flowability of the R—Fe—B powder material can be improved, and also oxidation of the R—Fe—B alloy can be prevented.

Note that as used herein, a powder material to be compacted, including not only the "R—Fe—B alloy powder" but also the granulating agent and the lubricant, is called the "R—Fe—B alloy powder material", as being distinguished from the "R—Fe—B alloy powder" substantially composed of powder of only an R—Fe—B alloy (an oxide layer on the surface may be included).

As described above, the flowability and compactibility are improved by granulating an R—Fe—B alloy powder using any of normal paraffins, isoparaffins and depolymerized oligomers or a mixture thereof. For example, by granulating a powder (primary particles) having a mean particle size in the range of 1.5 μm to 5 μm into a granulated powder having a mean particle size in the range of 0.05 mm to 3 mm, the flowability and compactibility are significantly improved. Such a granulated powder has moderate rigidity permitting no disintegration occurring during transportation and loading. Therefore, a predetermined amount of the powder material can be loaded in a cavity stably and uniformly. Also, since the granulated powder has moderate rigidity, it disintegrates into the primary particles under application of an aligning magnetic field of 0.1 T to 0.8 T, and the primary particles are aligned in the magnetic field. A higher aligning magnetic field (for example, 2 T) may be applied. In addition, the resultant compact hardly has chips and fractures.

All of the granulating agents mentioned above are excellent in removability. They can be easily removed during sintering in an atmosphere of an inert gas such as argon gas (including rare gas and nitrogen gas) or in a vacuum. Therefore, with no degradation in magnetic properties due to residual carbon, a sintered magnet having excellent magnetic properties is obtained.

As described above, with use of the granulated powder described above, R—Fe—B alloy sintered bodies excellent in magnetic properties with a reduced variation in mass (that is, loading amount) can be produced with high production efficiency The method for producing a magnet of the R—Fe—B alloy sintered body of the embodiment of the present invention will be described in the order of the steps.

First, R—Fe—B alloy flakes are prepared by the strip casting process (see U.S. Pat. No. 5,383,978, for example). Specifically, an R—Fe—B alloy prepared by a known method is subjected to high-frequency melting to obtain a molten alloy. As the R—Fe—B alloy, those having compositions described in U.S. Pat. No. 4,770,723 and No. 4,792,368 can be suitably used, in addition to that described above.

The molten alloy is held at 1350° C., and then rapidly cooled on a single roll under the conditions of a roll circumferential velocity of about 1 m/sec, a cooling rate of 500° C./sec and a supercooling temperature of 200° C., to obtain alloy flakes having a thickness of 0.3 mm. The alloy flakes are then allowed to occlude hydrogen to be made brittle, to thereby obtain a rough alloy powder. The rough alloy powder is finely pulverized with a jet mill in a nitrogen gas atmosphere, to obtain an alloy powder (primary particles) having a mean particle size of 1.5 μm to 5 μm and a BET specific surface of about 0.45 $m^2/g$ to about 0.55 $m^2/g$, for example. The true density of the alloy powder is 7.5 $g/cm^3$.

The alloy powder obtained is then granulated.

As the granulating agent, used is at least one kind of granulating agent selected from normal paraffins, isoparaffins and depolymerized oligomers. Naturally, a mixture of these agents may be used. Examples of preferred depolymerized oligomers include a copolymer of isobutylene and normal butylene, a homopolymer of isobutylene, a homopolymer or copolymer of alkyl methacrylate (for example, methyl methacrylate, ethyl methacrylate, propyl methacrylate, butyl methacrylate, isobutyl methacrylate and tertiary butyl methacrylate), and a homopolymer or copolymer of alkylene glycol (for example, ethylene glycol and propylene glycol). The depolymerized oligomer has a comparatively large number of branch structures in molecules, and for this reason, is considered having a comparatively high viscosity and moderate binding force.

In addition to the granulating agent described above, a terpene resin (for example, rosin, a terpene phenol resin and a dimmer of limonene) or an aliphatic resin (for example, polymers of butylene, pentene and the like) may be added to improve the binding force. The added amount of such a resin is preferably in the range of 0.05 mass % to 1.0 mass %.

The granulating agents described above have lubricity and moderate binding force, and also are excellent in removability. The mean molecular weight of the granulating agents is preferably in the range of 120 to 500. A granulating agent of which the mean molecular weight is below 120 is weak in binding force, finding difficulty in providing a stable granulated powder. A granulating agent of which the mean molecular weight exceeds 500 has a large amount of carbon remaining in the resultant sintered body, and this disadvantageously degrades the magnetic properties. The mean molecular weight is more preferably in the range of 140 to 450.

Among the normal paraffins and isoparaffins, a material preferred with respect to the boiling point can be specified. One having a boiling point in the range of 80° C. to 250° C. is preferred. One having a boiling point below 80° C. is weak in binding force, finding difficulty in providing a stable granulated powder. One having a boiling point exceeding 250° C. has a large amount of carbon remaining in the resultant sintered body, and this disadvantageously degrades the magnetic properties. As for the normal paraffins and isoparaffins, therefore, one having a mean molecular weight in the range of 140 to 450 or a boiling point of 100° C. to 230° C. is further preferred. By addition of a comparatively small amount of such a material, a sufficient effect will be obtained.

Naturally, in the case of using a mixture of two or more kinds of normal paraffins, isoparaffins and depolymerized oligomers, the respective components should preferably satisfy the conditions described above.

The added amount of the granulating agent used for preparation of the granulating powder is preferably in the range of 0.1 mass % to 50 mass % with respect to the mass of a powder. If the added amount of the granulating agent is below 0.1 mass %, the powder (primary particles) fail to be granulated. If it exceeds 50 mass %, the binding force becomes so strong that disintegration of the granulating powder under application of a magnetic field is difficult. In addition, the amount of carbon remaining in the resultant sintered body is large, causing degradation in magnetic properties. The added amount of the granulating agent is more preferably 0.1 mass % to 10 mass %, further more preferably 0.2 mass % to 10 mass %.

The granulating step is executed by any of various known processes. For example, an agitating granulation process, a vibrating granulation process, a tumbling granulation process, a fluidized bed granulation process and the like may be used. Among others, the fluidized bed granulation process is preferred, in which the resultant granulated powder has a particle shape close to a sphere and also has moderate rigidity. A granulated powder in a near-spherical shape is excellent in flowability and compactibility. The rigidity of the granulated powder, which may also be affected by the granulating agent, will cause a problem if it is excessively high or low as described above.

Figure 2:
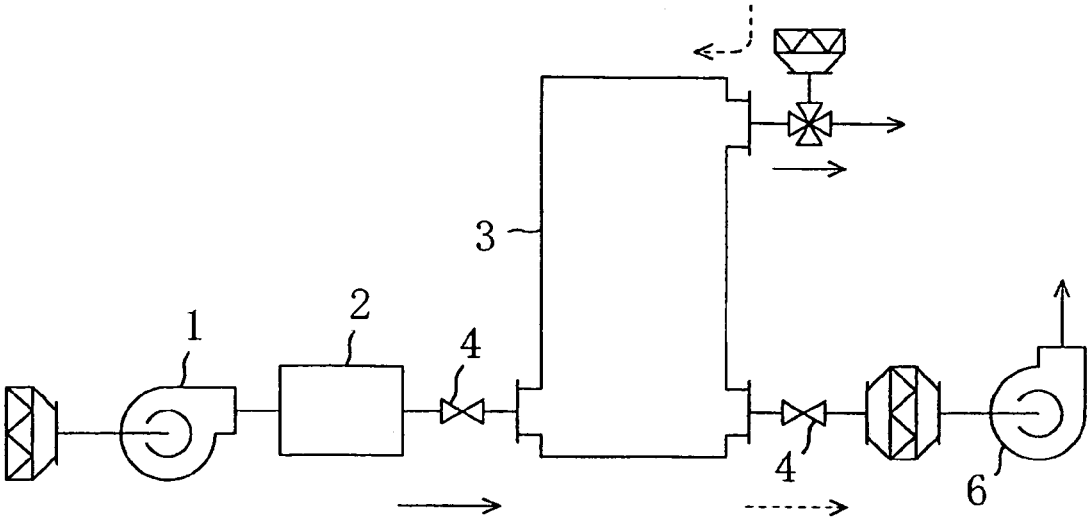
FIG. 2 is a diagrammatic view of granulation equipment 10 used for production of an R—Fe—B alloy granulated powder of the present invention.

Granulation equipment 10 for granulating a powder by the fluidized bed granulation process is diagrammatically shown in FIG. 2. The granulation equipment 10 includes an air blower 1, a thermostat/humidistat 2, a fluidization tank 3, switch valves 4 and an inverse pressure blower 6. As such granulation equipment 10, a swing processor from Fuji Paudal Co., Ltd. can be suitably used.

First, with an airflow supplied from the air blower 1, normal fluidization is performed in the fluidization tank 3. The air flows as shown by the solid arrows in FIG. 2 under positive pressure (fluidization stage). Thereafter, by switching the switch valves 4, the air flows as shown by the dashed lines in FIG. 2 with the inverse pressure blower 6 (compaction stage). In the compaction stage, a powder layer is formed and compressed with a downward airflow, increasing the rigidity of a granulated powder. The powder layer formed in the compaction stage is then broken with an upward airflow, and by an abrasion function of the fluidized air, formed into a granulated powder in a near-spherical shape. The switch valves 4 may be repeatedly switched. By controlling the air amount and the repetition cycle, the rigidity of the granulated powder can be adjusted. In addition, by controlling the duration of the granulating step, the mean particle size of the granulated powder can be adjusted.

The mean particle size of the granulated powder is preferably in the range of 0.05 mm to 3.0 mm. In general, the amount of primary particles included in the granulated powder is miniscule, and also the amount of tertiary or higher-order particles is very small. Therefore, the mean particle size of the secondary particles can be substantially regarded as representing the mean particle size of the granulated powder. Herein, as the mean particle size of the granulated powder, the mean particle size of the secondary particles as measured from microscopic observation is used. If the mean particle size of the granulated powder is below 0.05 mm, the effect of improving the flowability is small. Therefore, it is difficult to obtain a compact uniform in density. If the mean particle size of the granulated powder exceeds 3 mm, uniform loading of the powder in a cavity is difficult. Therefore, it is difficult to obtain a uniform compact with sufficient density. The mean particle size of the granulated powder is more preferably in the range of 0.1 mm to 2.0 mm.

The resultant granulated powder is then compacted to produce a compact. Herein, assume that a compact is produced using only a granulated powder. Any of known press equipment may be used for the compaction. Typically, a uniaxial press is used in which powder in a cavity of a die (die hole) is compacted with upper and lower punches. The granulated powder is transported per batch with a highly airtight container with nitrogen gas filled or flown therein.

The granulated powder is loaded into a cavity of a die of a uniaxial press. This loading can be realized by a method using a sieve, or any of methods using a feeder box described in Japanese Patent Publication for Opposition No. 59-40560, Japanese Laid-Open Patent Publication No. 10-58198, Japanese Laid-Open Utility Model Publication No. 63-110521 and Japanese Laid-Open Patent Publication No. 2000-248301 (these methods are collectively called a "drop method" in some cases due to their use of gravity drop).

In the case of producing a small compact, in particular, the granulated powder is preferably metered using the cavity to correspond to the volume of the capacity. For example, during loading of the granulated powder into the cavity, the granulated powder may be leveled off from the cavity with a bar member of a feeder box reciprocating above the cavity. By this way of loading, a predetermined amount of granulated powder can be loaded comparatively uniformly.

Once the granulated powder is loaded in the cavity, the upper punch of the uniaxial press is lowered, and a magnetic field is applied after the opening of the cavity is closed, to allow the granulated powder to disintegrate into primary particles and also the primary particles to be aligned in the magnetic field. The granulated powder according to the present invention, which has moderate rigidity, disintegrates under a comparatively weak magnetic field of 0.1 T to 0.8 T. For securing a sufficient degree of alignment, however, a magnetic field of 0.5 T to 1.5 T is desirable. The magnetic field is applied in the direction perpendicular to the compacting direction. Under the application of the magnetic field in this way, the powder material is uniaxially compacted with the upper and lower punches at a pressure of 98 MPa, for example. As a result, a compact with a relative density (=density of the compact/true density) of 0.5 to 0.7 is obtained. The direction of the magnetic field may be parallel with the compacting direction if this is appropriate. A static magnetic field or a pulse magnetic field may be used as the aligning magnetic field.

The compact obtained is then sintered at a temperature of about 1000° C. to about 1180° C., for example, in a vacuum or in an inert gas atmosphere (compressed, preferably) for about one to six hours. The granulating agent according to the present invention, which is excellent in removability, is substantially removed during this sintering. That is to say, the sintering step can serve as the debindering step. Alternatively, the debindering step may be provided separately before the sintering step. For example, the debindering step may be performed at a temperature of about 200° C. to about 800° C. in a compressed inert gas atmosphere at a pressure of about 2 Pa for about three to six hours.

The resultant sintered body is subjected to aging at a temperature of about 450° C. to about 800° C., for example, for about one to eight hours, to obtain an R—Fe—B sintered magnet. The R—Fe—B sintered magnet is finally completed by magnetization at a subsequent arbitrary stage.

According to the present invention, in which a granulated powder excellent in flowability and compactibility is used as described above, the powder can be loaded into the cavity uniformly with a reduced variation in loading amount. Therefore, variations are small in the mass and size of the compacts obtained by the compaction. Also, chips and fractures are less formed in the compacts. In addition, degradation in magnetic properties, which may occur if the granulating agent remains in the sintered body, is suppressed. Therefore, a sintered magnet excellent in magnetic properties can be attained. In this way, according to the present invention, a high-quality R—Fe—B alloy sintered magnet can be produced with high production efficiency.

EXAMPLES

Hereinafter, examples of the present invention will be described.

An R—Fe—B alloy powder was prepared in the following manner. A molten alloy was prepared using 99.9% purity electrolytic iron, a ferroboron alloy containing 19.8% of B, and Nd and Dy having a purity of 99.7% or more as the starting materials. The molten alloy obtained was subjected to the strip casting process, to obtain R—Fe—B alloy flakes having a composition of 14.5 at. % of Nd, 0.5 at. % of Dy, 78.8 at. % of Fe and 6.2 at. % of B. The flakes obtained were finely pulverized in an inert gas atmosphere (for example, $N_2$ gas at a gas pressure of 58.8 MPa) with a jet mill, to obtain a fine powder having a mean particle size of 3 μm.

A granulated powder was produced by the fluidized bed granulation process (using a swing processor from Fuji Paudal Co., Ltd., for example). Various kinds of granulating agents were used for the granulation. The compositions and amounts of the granulating agents used for production of granulated powders in Examples 1 to 16 are shown in Tables 1 and 2. The compositions of granulating agents used for production of granulated powders in Comparative Examples 1 to 9 are shown in Table 3. The granulation using PVA as the granulating agent in Comparative Examples 6, 7 and 8 was performed with a spray dryer. In Comparative Example 9, no granulation was performed, but fine powder was used as it was.

The granulated powder obtained was loaded into cavities of 20 mm long×15 mm wide×10 mm deep by a method using a feeder box described above, and then uniaxially compacted (at a pressure of 98 MPa under application of an aligning magnetic field (0.8 T) perpendicular to the compacting direction). These loading step and compacting step were performed under the same conditions throughout the examples and the comparative examples.

The resultant compact was sintered at 1060° C. in an Ar atmosphere for about four hours and then subjected to aging at 600° C. for one hour, to obtain a sintered body. The sintered body was then magnetized under 2387 kA/m, to obtain a sintered magnet. A total of 50 samples were produced for each of the examples and the comparative examples.

The process steps following the compacting step were substantially the same throughout Examples 1 to 15 and Comparative Examples 1 to 9, except that the sintering was performed at 1060° C. in a hydrogen atmosphere for four hours in Comparative Examples 6, 7 and 8 in which PVA was used as the granulating agent. The reason is that PVA is not sufficiently removed by the sintering in an Ar atmosphere.

The sintered magnets in the examples and comparative examples were produced in the manner described above. In the process of the above production, the following items were evaluated.

The granulation capability was evaluated as to whether or not a granulated powder was successfully produced by the method described above and whether or not the granulated powder obtained disintegrated during the transportation and the loading. The evaluation results are shown in Tables 1 and 2, in which ○ was given to a granulated powder satisfying all of these points, Δ was given to a granulated powder having practicability although some problem existed, and X was given to a granulated powder low in practicability.

The removability was evaluated in terms of the amount of carbon remaining in the sintered body and the magnetic properties of the sintered magnet. The evaluation results are shown in Tables 1 and 2, in which ○ was given to a granulated powder small in degradation in magnetic properties due to carbon remaining in the sintered body, Δ was given to a granulated powder having practicability although degradation in magnetic properties was not negligible, and X was given to a granulated powder low in practicability exhibiting significant degradation in magnetic properties due to carbon remaining in the sintered body.

As for the granulated powders in Example 12 and Comparative Examples 6 and 9, the variation (%) in the mass of the compact and the variation (σ) in loading amount were evaluated. The variation in the mass of the compact was calculated from {(maximum mass-minimum mass)/mean mass (n=50)}×100 (%). The variation (σ) in loading amount represents the standard deviation of the mass distribution of 50 compacts. The results are shown in Table 4.

Figure 3:
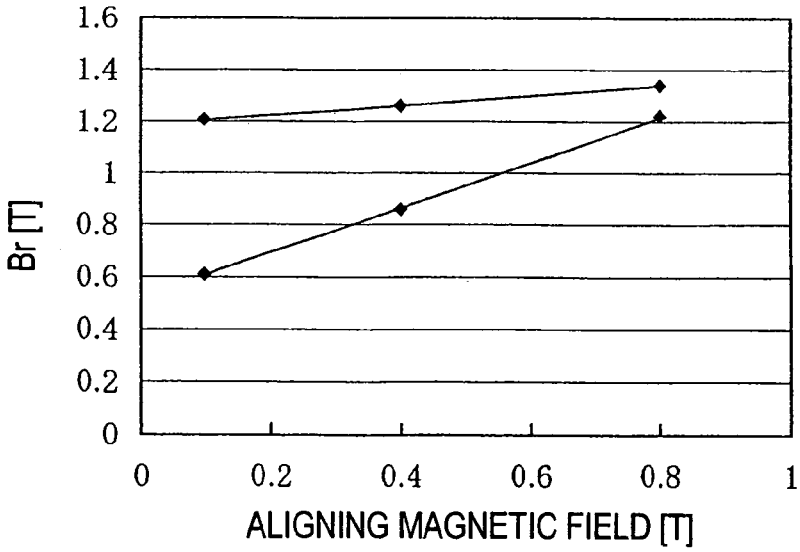
FIG. 3 is a graph showing the relationship between the magnetic flux density of the aligning magnetic field and the remanence of the resultant sintered magnet, for granulated powders in Example 12 and Comparative Examples 6 and 9.

As for the granulated powders in Example 12 and Comparative Examples 6 and 9, also, the magnetic field alignment property was evaluated, in which the magnetic flux density of the aligning magnetic field applied in the compacting step was changed from 0.1 T to 0.4 T and 0.8 T, and the magnetic properties (remanence Br and cohesive force iHc) of the resultant sintered magnets were evaluated. The evaluation results are shown in Table 4 and FIG. 3. FIG. 3 is a graph obtained by plotting the magnetic flux density of the aligning magnetic field on the x-axis and the remanence of the resultant sintered body on the y-axis. As for the other examples and comparative examples, the magnetic flux density of the aligning magnetic field was set at 0.8 T, and the evaluation results of the magnetic properties of the resultant sintered bodies are shown in Tables 5, 6 and 7.

TABLE 1

| Composition of granulating agent (molecular weight)/ mass % | Ex. 1 | Ex. 2 | Ex. 3 | Ex. 4 | Ex. 5 | Ex. 6 | Ex. 7 | Ex. 8 |
|---|---|---|---|---|---|---|---|---|
| Normal paraffin (140) | 100 | 100 | 90 | — | — | — | 95 | — |
| Normal paraffin (300) | — | — | 10 | — | — | — | — | — |
| Isoparaffin (140) | — | — | — | 100 | 90 | 90 | — | — |
| Isoparaffin (300) | — | — | — | — | 10 | 10 | 5 | — |
| Polybutene (200) | — | — | — | — | — | — | — | 100 |
| Polybutene (300) | — | — | — | — | — | — | — | — |
| Polybutene (500) | — | — | — | — | — | — | — | — |
| Added amount (mass %) | 10.0 | 5.0 | 1.0 | 5.0 | 0.5 | 3.0 | 1.0 | 3.0 |
| Granulation capability | ○ | ○ | ○ | ○ | ○ | ○ | ○ | ○ |
| Removability | ○ | ○ | ○ | ○ | ○ | ○ | ○ | ○ |

TABLE 2

| Composition of granulating agent (molecular weight)/ mass % | Ex. 9 | Ex. 10 | Ex. 11 | Ex. 12 | Ex. 13 | Ex. 14 | Ex. 15 | Ex. 16 |
|---|---|---|---|---|---|---|---|---|
| Normal paraffin (140) | 50 | — | — | 30 | 30 | 30 | 30 | 30 |
| Normal paraffin (300) | — | — | — | — | — | — | — | — |
| Isoparaffin (140) | — | 95 | 95 | 65 | 65 | 65 | 65 | 65 |
| Isoparaffin (300) | — | — | — | — | — | — | — | — |
| Polybutene (200) | 50 | — | — | — | — | — | — | — |
| Polybutene (300) | — | — | — | 5 | 5 | 5 | 5 | 5 |
| Polybutene (500) | — | 5 | 5 | — | — | — | — | — |
| Added amount (mass %) | 3.0 | 1.0 | 7.0 | 2.0 | 10.0 | 30.0 | 50.0 | 65.0 |
| Granulation capability | ○ | ○ | ○ | ○ | ○ | ○ | ○ | Δ |
| Removability | ○ | ○ | ○ | ○ | ○ | ○ | ○ | Δ |

TABLE 3

| Composition of granulating agent (molecular weight)/ mass % | Com Ex. 1 | Com Ex. 2 | Com Ex. 3 | Com Ex. 4 | Com Ex. 5 | Com Ex. 6 | Com Ex. 7 | Com Ex. 8 | Com. Ex. 9 |
|---|---|---|---|---|---|---|---|---|---|
| Normal hexane (86) | 100 | 90 | 50 | 90 | — | — | — | — | — |
| Polybutene (650) | — | 10 | 50 | — | 3 | — | — | — | — |
| Polybutene (1000) | — | — | — | 10 | — | — | — | — | — |
| Liquid paraffin | — | — | — | — | 97 | — | — | — | — |
| Polyvinyl alcohol (PVA) | — | — | — | — | — | 100 | 100 | 100 | — |
| Added amount (mass %) | 2.0 | 5.0 | 5.0 | 2.0 | 2.0 | 2.0 | 5.0 | 10.0 | 0.0 |
| Granulation capability | X | ○ | ○ | ○ | ○ | ○ | ○ | ○ | X |
| Removability | ○ | X | X | X | X | X | X | X | ○ |

TABLE 4

| | Example 12 | | | Comparative Ex. 9 | | | Comparative Ex. 6 | | |
|---|---|---|---|---|---|---|---|---|---|
| Aligning magnetic field(T) | 0.1 | 0.4 | 0.8 | 0.1 | 0.4 | 0.8 | 0.1 | 0.4 | 0.8 |

TABLE 4-continued

| | Example 12 | | | Comparative Ex. 9 | | | Comparative Ex. 6 | | |
|---|---|---|---|---|---|---|---|---|---|
| Br (T) | 1.20 | 1.26 | 1.34 | 1.21 | 1.26 | 1.35 | 0.60 | 0.85 | 1.22 |
| iHc (kA/m) | 1261 | 1185 | 1139 | 1240 | 1200 | 1135 | 1250 | 1211 | 1145 |
| Variation in Mass of Compact (%) | | 5.4 | | | 14.6 | | | 4.6 | |
| Variation in loading (σ) | | 0.18 | | | 0.33 | | | 0.16 | |

TABLE 5

| Item | Ex. 1 | Ex. 2 | Ex. 3 | Ex. 4 | Ex. 5 | Ex. 6 | Ex. 7 | Ex. 8 |
|---|---|---|---|---|---|---|---|---|
| Br (T) | 1.34 | 1.35 | 1.34 | 1.34 | 1.35 | 1.34 | 1.34 | 1.34 |
| iHc (kA/m) | 1135 | 1142 | 1140 | 1149 | 1133 | 1145 | 1151 | 1153 |

TABLE 6

| Item | Ex. 9 | Ex. 10 | Ex. 11 | Ex. 12 | Ex. 13 | Ex. 14 | Ex. 15 | Ex. 16 |
|---|---|---|---|---|---|---|---|---|
| Br (T) | 1.34 | 1.34 | 1.34 | 1.34 | 1.34 | 1.34 | 1.34 | 1.30 |
| iHc (kA/m) | 1148 | 1140 | 1154 | 1139 | 1144 | 1146 | 1151 | 1121 |

TABLE 7

| Item | Com.Ex. 1 | Com.Ex. 6 | Com.Ex. 9 |
|---|---|---|---|
| Br (T) | 1.35 | 1.22 | 1.35 |
| iHc (kA/m) | 1138 | 1145 | 1135 |

The results shown in Tables 1, 2 and 3 will be described. It is found that appropriate granulation capability was exhibited in Examples 1 to 16, which use normal paraffin (mean molecular weight: 140, boiling point: 170° C.), normal paraffin (mean molecular weight: 300, boiling point: 315° C.), isoparaffin (mean molecular weight: 140, boiling point: 166° C.), isoparaffin (mean molecular weight: 300, boiling point: 277° C.), polybutene as a copolymer of isobutylene and normal butylene (mean molecular weight: 200), polybutene (mean molecular weight: 300) and/or polybutene (mean molecular weight: 500) as the granulating agent in an added amount of 0.5 mass % to 65 mass % with respect to the alloy powder (Tables 1 and 2).

On the contrary, in Comparative Example 1 in which normal hexane (molecular weight: 86, boiling point 69° C.) was added as the granulating agent in an amount of 2.0 mass %, preparation of a stable granulated powder failed (Table 3). Preparation of a granulated powder also failed in Comparative Example 9 in which no granulating agent was added. Good granulation capability was exhibited in Comparative Examples 2 to 8 using polybutene (molecular weight: 650), polybutene (molecular weight: 1000), liquid paraffin (a mixture of alkyl naphthene hydrocarbon as a major ingredient, boiling point: 300° C. or higher) and/or PVA as the granulating agent in an added amount of 2.0 mass % to 10 mass % with respect to the alloy powder. However, in these comparative examples, the removability was poor and the magnetic properties degraded significantly. In particular, Comparative Examples 2, 3, 4, 5, 7 and 8 were significantly poor in removability and as a result failed to provide a sintered body. This is the reason why Table 7 does not include the evaluation results of these comparative examples. Comparative Example 6 using PVA in an added amount of 2.0 mass % was low in remanence Br.

As a result of the examination of various granulating agents, it is found that the mean molecular weight of the granulating agent is preferably in the range of 120 to 500, more preferably in the range of 140 to 450. If the mean molecular weight is excessively small, the binding force is weak, and therefore it is difficult to provide a stable granulated powder. On the contrary, if the mean molecular weight is excessively large, the amount of carbon remaining in the sintered body is large, causing degradation in magnetic properties. Among the normal paraffins and isoparaffins, a material preferred with respect to the boiling point can be specified. One having a boiling point in the range of 80° C. to 250° C. is preferred. As for the normal paraffins and isoparaffins, therefore, one having a mean molecular weight in the range of 140 to 450 or a boiling point in the range of 100° C. to 230° C. is further preferred. By addition of a comparatively small amount of such a material, a sufficient effect will be obtained.

A preferred range of the added amount of the granulating agent was examined. Among Examples 1 to 16 shown in Tables 1 and 2, the granulated powder in Example 16 having the granulating agent added in an amount of 65 mass % did not sufficiently disintegrate under the aligning magnetic field due to excessively strong binding force. In addition, the binder (that is, the granulating agent) was not sufficiently removed during the sintering in the Ar atmosphere described above. For these reasons, presumably, the magnetic properties were inferior to those in Examples 1 to 15. As a result of various examinations, it has been found that the added amount of the granulating agent should preferably be in the range of 0.1 mass % to 50.0 mass % to prepare a granulated powder having moderate rigidity resisting disintegration during the transportation and the loading but permitting disintegration under the aligning magnetic field. The added amount of the granulating agent is more preferably in the range of 0.2 mass % to 10 mass %, further more preferably in the range of 0.5 mass % to 5 mass %.

The granulated powder according to the present invention has excellent flowability and moderate rigidity. This will be demonstrated with reference to Table 4 and FIG. 3.

As is evident from Table 4, the variation in the mass of the compact in Example 12 is 5.4%, showing significant improvement from 14.6% in Comparative Example 9 involving no granulation. This also applies to the variation (σ) in loading amount. The variation (σ) in loading amount in Example 12 is 0.18, showing significant improvement from 0.33 in Comparative Example 9. This indicates that the flowability was improved by the granulation.

Naturally, the compactibility was also improved by the granulation. The percentage of formation of chips and fractures in the resultant compact was significantly low compared with that in Comparative Example 9. These effects of the granulation were also observed in the other examples.

It is also found from the results shown in Table 4 that the flowability and compactibility were improved by the granulation in Comparative Example 6 using PVA as the granulating agent. However, the granulated powder in Comparative Example 6 is excessively strong in biding force as described above, which is also evident from the relationship between the intensity of the aligning magnetic field and the magnetic properties of the resultant sintered body.

As shown in Table 4 and FIG. 3, the remanence Br in Example 12 is roughly the same as that in Comparative Example 9 using a non-granulated powder, and it is found that when the magnetic flux density of the aligning magnetic field was 0.1 T and 0.4 T, the powder was aligned to nearly the same degree as that shown when it was 0.8 T. On the contrary, the remanence Br in Comparative Example 6 significantly decreased with decrease of the magnetic flux density of the aligning magnetic field. The reason is that while the granulated powder in Example 12 roughly completely disintegrated into primary particles under an aligning magnetic field of 0.1 T or more, the granulated powder in Comparative Example 6 failed to sufficiently disintegrate even under the 0.8 T aligning magnetic field, and with a weaker magnetic field, the percentage of the disintegrating granulated powder significantly decreased.

INDUSTRIAL APPLICABILITY

According to the present invention, a granulated powder having moderate rigidity is produced with a granulating agent excellent in removability. Therefore, by use of the granulated powder according to the present invention, an R—Fe—B alloy sintered magnet having excellent magnetic properties can be produced with high productivity.

The invention claimed is:

1. A method for producing a granulated powder of an R—Fe—B alloy, comprising the steps of:

preparing an R—Fe—B alloy powder; and granulating a mixture consisting of the alloy powder and at least one kind of granulating agent selected from a group consisting of normal paraffins, isoparaffins and depolymerized oligomers and optionally a terpene resin or an aliphatic resin to prepare a granulated powder;

wherein the at least one kind of granulating agent is added in the step of granulating in an amount of 0.1 mass% to 50 mass% with respect to the mass of the granulated powder;

wherein the mean particle size of the alloy powder is in the range of 1.5 μm to 5 μm;

wherein the mean molecular weight of the at least one kind of granulating agent is in the range of 120 to 500; and wherein the granulated powder is prepared by a fluidized bed granulation process.

2. The method for producing a granulated powder of an R—Fe—B alloy of claim 1, wherein the at least one kind of granulating agent is normal paraffin and/or isoparaffin having a boiling point in a range of 80° C. to 250° C.

3. The method for producing a granulated powder of an R—Fe—B alloy of claim 1, wherein the mean particle size of the granulated powder is in a range of 0.05 mm to 3.0 mm.

4. A method for producing an R—Fe—B alloy sintered body comprising the steps of:

producing a granulated powder by the method for producing a granulated powder of an R—Fe—B alloy of claim 1;

compacting an R—Fe—B alloy powder material including the granulated powder in a state of being aligned under application of a magnetic field, to form a compact; and sintering the compact.

5. The method for producing an R—Fe—B alloy sintered body of claim 4, wherein the step of sintering comprises the step of heating the compact in an inert gas atmosphere or in a vacuum, and also serves as the step of removing the granulating agent.

6. The method for producing an R—Fe—B alloy sintered body of claim 4, wherein the powder material substantially includes only the granulated powder.

* * * * *